US005204664A

United States Patent [19]

Hamakawa

[11] Patent Number: 5,204,664

[45] Date of Patent: Apr. 20, 1993

[54] DISPLAY APPARATUS HAVING A LOOK-UP TABLE FOR CONVERTING PIXEL DATA TO COLOR DATA

[75] Inventor: Kouichi Hamakawa, Oora, Japan

[73] Assignee: Sanyo Electric Co., Ltd., Osaka, Japan

[21] Appl. No.: 696,967

[22] Filed: May 8, 1991

[30] Foreign Application Priority Data

May 16, 1990 [JP] Japan ..... 2-127383
Jul. 16, 1990 [JP] Japan ..... 2-188741

[51] Int. Cl.[5] ..... G09G 1/28

[52] U.S. Cl. ..... 340/703; 340/799

[58] Field of Search ..... 340/703, 701, 799, 721, 340/723

[56] References Cited

U.S. PATENT DOCUMENTS 4,484,187 11/1984 Brown et al. ..... 340/724
4,789,854 12/1988 Ishii ..... 340/703
4,818,979 4/1989 Manson ..... 340/799
4,853,681 8/1989 Takashima ..... 340/703
4,878,178 10/1989 Takakura et al. ..... 340/799

FOREIGN PATENT DOCUMENTS 8302509 7/1983 PCT Int'l Appl. ..... 340/703

*Primary Examiner*—Tommy P. Chin
*Assistant Examiner*—A. Au
*Attorney, Agent, or Firm*—Oliff & Berridge

[57] ABSTRACT

A frame buffer stores pixel data for each pixel. The pixel data are converted into color data according to color data at a corresponding address in a first look-up table (LUT). An overlay memory stores change data representing presence/absence of color change for each pixel and change pixel data. According to contents of change pixel data in the overlay memory, color data at a corresponding address in a second look-up table are read, thereby converting the change pixel data into color data. To display an image, data stored in both of the frame buffer and the overlay memory are read for each pixel. To perform color change, the change pixel data are used instead of the pixel data. When change data in the overlay memory indicate presence of color change, change pixel data are converted into color data with reference to the second look-up table. Then the color data are exhibited on a CRT display. Color change can be also performed by an address designating circuit which is provided in place of the second look-up table and is used for changing an address to be read with reference to the first look-up table.

2 Claims, 3 Drawing Sheets

DISPLAY APPARATUS HAVING A LOOK-UP TABLE FOR CONVERTING PIXEL DATA TO COLOR DATA

BACKGROUND OF THE INVENTION

1. Field of the Invention

This invention relates to a display apparatus which displays an image based on color data which are obtained by converting pixel data in a frame buffer by using a look-up table (hereinafter called "LUT").

2. Description of the Related Art

In a display apparatus currently known, a frame buffer stores pixel data for each pixel in a display screen, and outputs the pixel data as an address to an LUT disposed between the frame buffer and the image display so as to display a color graphic image by pixels having desired colors. Such a display apparatus is disclosed in Japanese Patent Laid-Open Publication 31184/1985.

To change the color of some pixels, color data whose addresses are designated by pixel data are usually overlaid with different color data in the LUT.

This method is advantageous in that the color can be changed instantly. However, if there are other pixels having the same pixel data in the frame buffer, the color of all the pixels having the same pixel data are changed simultaneously, thereby causing not only the desired area but also some undesired areas to be color-changed.

There is also known a method in which a color is changed by replacing pixel data in the frame buffer with pixel data of the newly desired color. This method is advantageous in that the color of only the desired area can be changed, but takes a lot of time to change the original color to the desired color or vice versa. In addition, an extra memory is required for storing the original color data temporarily. The second mentioned method is not so preferable for the above reasons.

SUMMARY OF THE INVENTION

It is therefore an object of this invention to provide a display apparatus which can facilitate change and restoration of a color for each pixel.

According to a first aspect of this invention, there is provided a display apparatus comprising: a frame buffer for storing pixel data corresponding to each pixel of a display screen; a first look-up table for converting pixel data read from the frame buffer into color data; an overlay memory having areas for the respective pixels of the display screen and for storing change data representing presence/absence of color change in a desired area; a second look-up table for converting the change pixel data read from the overlay memory into color data; and a selector circuit for selecting color data outputted from either the first look-up table or the second look-up table according to the change data.

With this arrangement, when change pixel data and data representing presence of color change are written in an overlay memory at a pixel location, the color data corresponding to the change pixel data are automatically selected from the second LUT by a selector circuit, so that the color of the desired pixel will be changed. In this case, if there are the same pixel data at another pixel location in the frame buffer, the color of this pixel location will not be changed.

In addition, if color change is performed, the contents of the frame buffer remain as they are. Therefore the original color can be restored only by clearing the contents of the overlay memory.

According to a second aspect of this invention, there is provided a display apparatus comprising: a frame buffer for storing pixel data corresponding to each pixel of a display screen; a look-up table for storing a plurality of color data to be displayed on said display screen; an overlay memory having areas for the respective pixels of the display screen and for storing change pixel data for designating an area whose color is to be changed; and an address designating circuit for accepting the pixel data and change pixel data and for supplying said look-up table with either an address corresponding to the new pixel data when the change pixel data have a specific value or an address corresponding to the original pixel data when the change pixel data do not have the specific value.

With the second arrangement, when change pixel data having a value different from a predetermined specific value are written in an overlay memory at a pixel location so as to change the color, the color data at an address corresponding to the change pixel data are outputted from the LUT, thereby changing the color of the pixel. In this case, the same pixel data existing at other pixel locations in the frame buffer will not be affected.

In addition, since the contents of the frame buffer remain unchanged, the original color can be restored only by clearing the contents of the overlay memory.

The above and other advantages, features and additional objects of this invention will be manifest to those versed in the art upon making reference to the following detailed description and the accompanying drawings in which several preferred embodiments incorporating the principles of this invention are shown by way of illustrative example.

DETAILED DESCRIPTION

The principles of this invention are particularly useful when embodied in image displays such as shown in FIGS. 1 through 5.

Embodiment 1

Figure 1:
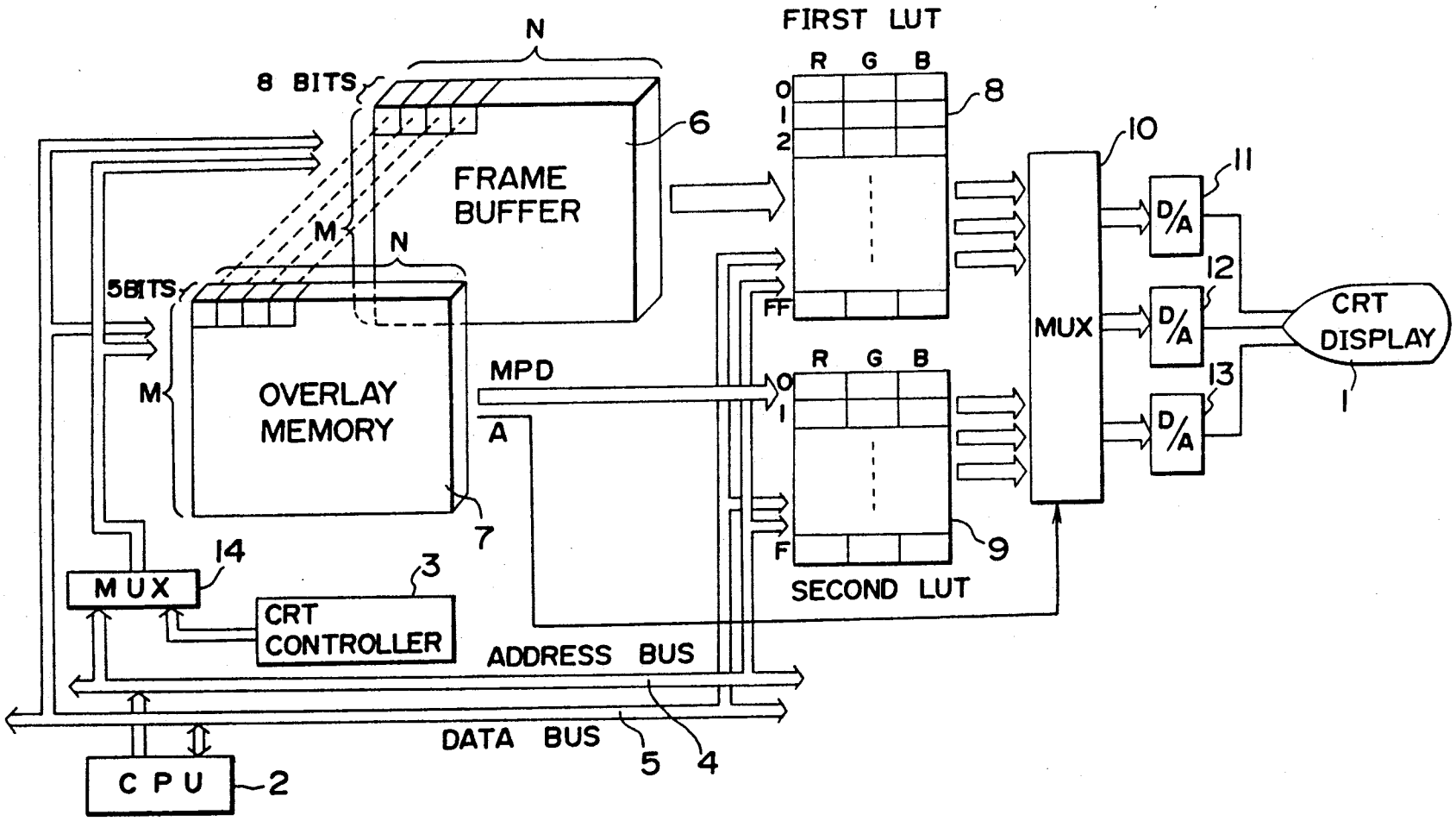
FIG. 1 is a block diagram of a display apparatus according to a first embodiment of this invention.

As shown in FIG. 1, the image display comprises a CRT display 1, a CPU 2 as a processing unit, a CRT controller 3 as a display control unit, an address bus 4, a data bus 5, a frame buffer 6 including M×N areas for respective pixels in the display 1 and for storing 8-bit pixel data for each pixel, and an overlay memory 7 including M×N areas and for storing 5-bit data for each pixel. The color change data are written in the overlay memory 7 as described later.

Figure 2:
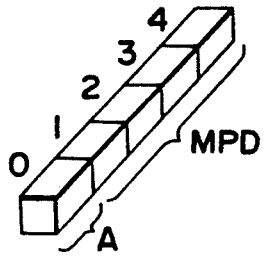
FIG. 2 shows a data format of an overlay memory for the image display of FIG. 1.

As shown in FIG. 2, in the overlay memory, data for one pixel includes one change bit A for representing presence/absence of the color change, and four bits of change pixel data MPD.

In FIG. 1 again, a first LUT 8 has 256 ($=2^8$) entries, each of which stores eight bits of color data each for the colors R, G and B, i.e. a total of 24 bits of color data. The first LUT accepts 8-bit pixel data as an address read from the frame memory 6, outputting color data for the address-designated entry. A second LUT 9 has 16 ($=2^4$) entries, stores in each entry a total of 24 bits of color data for R, G, and B similarly to the first LUT 8. The second LUT 9 accepts 4 bits of change pixel data MPD read from the overlay memory as an address, outputting color data for the entry whose address is designated. A multiplexer MUX 10 accepts the color data outputted by the first and second LUTs 8 and 9, selectively outputting the color data of the first or second LUT according to the change bit A from the overlay memory 7. DA converters 11, 12, 13 convert the respective 8-bit color data for R, G, B outputted from the multiplexer MUX 10 into analog signals, supplying them to the display 1.

When it is "1", the change bit A represents presence of color change, while when it is "0", the change bit A represents absence of color change. The MUX 10 is adapted to select the color data from the second LUT 9 when the change bit A is "1". Otherwise, the MUX 10 is adapted to select the color data from the first LUT 8. Both the frame buffer 6 and the overlay memory 7 accept the same display address from the CRT controller 3 via an MUX 14. The data for the same pixel location are read simultaneously during scanning.

Operation of the image display will now be described.

When no color change is being performed at all, the contents of the overlay memory 7 have been cleared entirely. Therefore the MUX 10 always selects the first LUT 8. The pixels in the display 1 show the color data whose addresses are designated in the first LUT 8 according to the pixel data in the frame buffer 6.

To change a color of a pixel $P_1$, the CPU 2 writes the change bit A=1 and the change pixel data in the overlay memory 7 at an area for the pixel $P_1$. Then since the change bit A is "1", the MUX 10 selects the second LUT 9 to display the pixel $P_1$. The first LUT 8 does not output the color data according to the pixel data stored at the area for the pixel $P_1$ in the frame buffer 6. The display 1 exhibits the color data from the second LUT 9 according to the change pixel data from the overlay memory 7. Even when the pixel data same as those of the pixel $P_1$ are stored in an area for the pixel $P_2$, for example in addition to the area for the pixel $P_1$, there are no data at the area for the pixel $P_2$ in the overlay memory 7, so that the pixel $P_2$ displays the color data from the first LUT 8 as they are according to the pixel data stored in the frame buffer 6.

To restore the original color of the pixel $P_1$, the color data related to the pixel $P_1$ in the overlay memory 7 are cleared to "0" by the CPU 2.

Suppose that "2H" as pixel data are written in the areas for the pixels $P_1$ and $P_2$ in the frame buffer 6, "1 1 1 1 1 1 1 1, 0 0 0 0 0 0 0 0, 0 0 0 0 0 0 0 0" are written as R, G, B at the address 2H of the first LUT 8, and "0 0 0 0 0 0 0 0, 1 1 1 1 1 1 1 1, 0 0 0 0 0 0 0 0" are written as R, G, B at the address 1H of the second LUT 9.

When no color change is performed under this condition, the pixels $P_1$ and $P_2$ show pure red according to the color data "1 1 1 1 1 1 1 1, 0 0 0 0 0 0 0 0, 0 0 0 0 0 0 0 0".

On the other hand, when the change bit A=1 and the change pixel data 1H are written at the area for the pixel $P_1$ in the overlay memory 7 so as to change the color of the pixel $P_1$ to pure green, the color data, "0 0 0 0 0 0 0 0, 1 1 1 1 1 1 1 1, 0 0 0 0 0 0 0 0" whose address is designated in the second LUT 9 according to the change pixel data 1H, are selected by the MUX 10, thereby showing the pixel $P_1$ in pure green. However the pixel $P_2$ remains pure red.

Then if the data in the area for the pixel $P_1$ are cleared to "0" in the overlay memory 7, the pixel $P_1$ returns to the original pure red.

In the foregoing embodiment, the number of bits for the change pixel data is four (corresponding to 16 entries in the second LUT), and that of the color data is 24. Therefore, sixteen (16) colors can be changed out of 16.7 million colors ($=2^8\times2^8\times2^8$).

Embodiment 2

Figure 3:
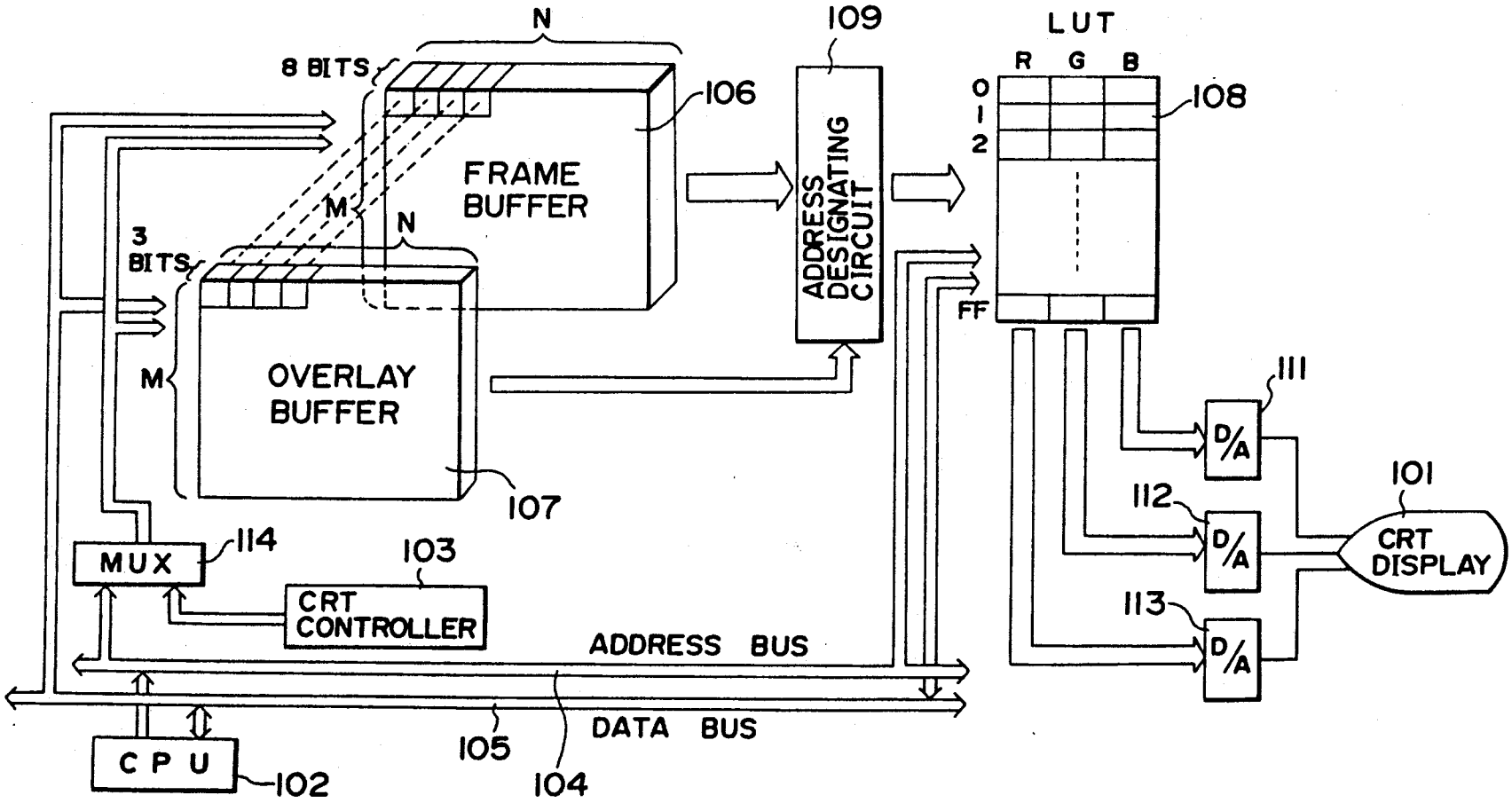
FIG. 3 is a block diagram of a display apparatus according to a second embodiment of the invention.

As shown in FIG. 3, a display apparatus according to a second embodiment comprises a CRT display 101, a CPU 102, a CRT controller 103, an address bus 104 and a data bus 105 as data transmitting means, a frame buffer 106 having M×N areas for respective pixels in the display 101 and for storing 8-bit pixel data for each pixel, and an overlay memory 107 having M×N areas similarly to the frame buffer 106 and for storing 3-bit change pixel data for each pixel. The color change data are written in the overlay memory 107 as described later.

An LUT 108 has 256 ($=2^8$) entries, each of which stores eight bits each for R, G, B, i.e. a total of 24 bits of color data. The LUT 108 outputs color data for the entry whose address has been designated by an address designating circuit 109 to be described later. DA converters 111, 112, 113 convert each 8-bit color data for R, G, B from the LUT 10 into analog signals, which are transmitted to the display 101.

The address designating circuit 109 accepts the 8-bit pixel data from the frame buffer 106 and the 3-bit change pixel data from the overlay memory 107. When the change pixel data have a specific value, the address designating circuit 109 outputs to the LUT 108 the pixel data as an address as they are, while the circuit 109 outputs to the LUT 108 a predetermined address when the change pixel data do not have the specific value.

Figure 4:
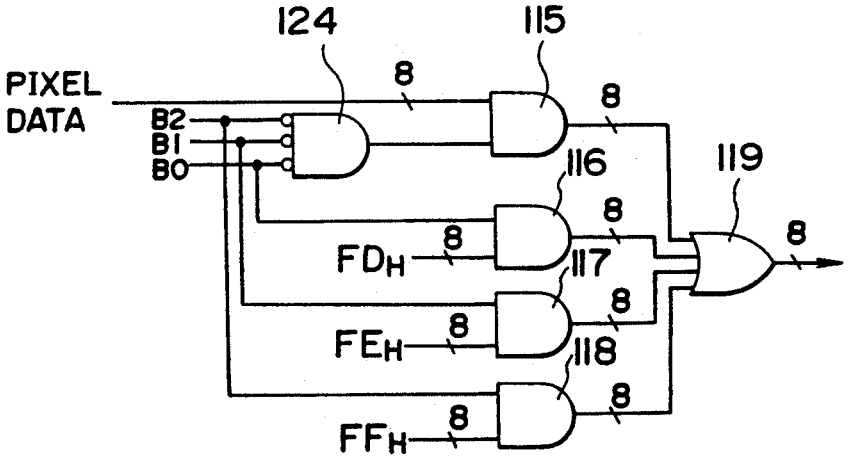
FIGS. 4 and 5 are schematic diagrams showing examples of address designating circuits for the image display of FIG. 3.

Specifically as shown in FIG. 4, the address designating circuit 109 includes a decoder 124 for decoding all 0's in the pixel data B0, B1, B2, an AND gate 115 for accepting decoded outputs from the decoder 124 and pixel data from the frame buffer 106, AND gates 116, 117, 118 for accepting respectively the bits B0, B1, B2, and addresses $FD_H$, $FE_H$, $FF_H$, and an OR gate 119 for accepting four AND gate outputs. In this embodiment, when the change pixel data (B2, B1, or B0) are (0 0 0), the pixel data without change are outputted as an address. Otherwise, according to a bit position of "1", the address $FD_H$ will be outputted for (0 0 1), $FE_H$ for (0 1 0), or $FF_H$ for (1 0 0) as determined beforehand.

Figure 5:
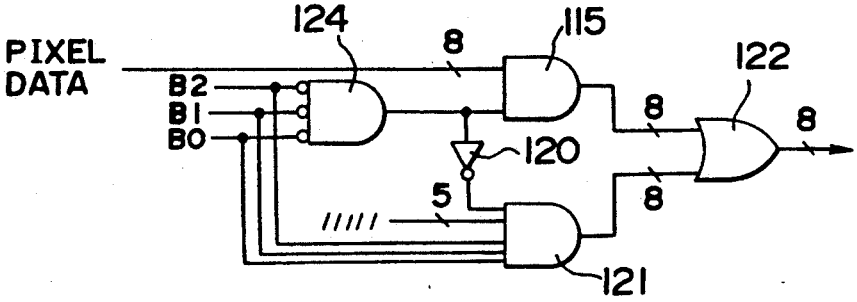

Another example of the address designating circuit 109 is shown in FIG. 5. In this circuit, an inverter 120 accepts an inverted decode output instead of the three AND gates 116, 117, 118. An AND gate 121 is provided so as to input a fixed value to put all 1's in the high order bit, and input B2 to B0 to the lower order bits. An OR gate 122 is provided so as to accept outputs from the AND gates 121 and 115. When the change pixel data are other than (0 0 0), one of the addresses $F9_H$ to $FF_H$ will be designated according to the seven values (0, 0, 1) to (1, 1, 1) of the data (B2, B1, B0) in the LUT 8.

Since both of the frame buffer 106 and the overlay memory 107 accept the same display address from the CRT controller 103 through the MUX 114, the data for the same pixel position are read out simultaneously during scanning.

Operation of the image display will now be described.

When the image display is turned on, both of the frame buffer 106 and the overlay memory 107 are cleared, so that all zero data will be written in each area. To display an image, the CPU 102 writes pixel data in the frame buffer 106. Since the change pixel data are all 0's in the overlay memory 107 under this condition, the address designating circuit 109 outputs to the LUT 108 the pixel data as an address without change. The LUT 108 outputs the color data corresponding to the pixel data.

When (1 0 0) as change pixel data (B2, B1, B0) is written in the overlay memory at the area for the pixel $P_1$ for which the color is to be changed, the address designating circuit 109 of FIG. 4 supplies the LUT 108 the address $FF_H$ for the change pixel data (1 0 0) regardless of pixel data which have been written in the frame buffer 106 at the area for the pixel $P_1$. Therefore, the LUT 108 outputs the color data stored at the address $FF_H$, so that the color designated by the color data is shown by the pixel $P_1$ on the display 101. Even when the pixel data same as those of the pixel $P_1$ are also stored in the frame buffer 106 at an area for a pixel $P_2$, no data are written in the overlay memory 107 at the area for the pixel $P_2$, so that the color data whose address is designated by the pixel data stored in the frame buffer 106 will be outputted by the LUT 108 without change. Therefore the pixel $P_2$ shows the color corresponding to the color data. In the circuit of FIG. 5, only the address $FC_H$ (1 11 1 11 0 0) is designated instead of the address $FF_H$. The other operations are the same as those described above.

To restore the original color for the pixel $P_1$, the data in the overlay memory 107 at the area for the pixel $P_1$ are cleared to "0" by the CPU 102.

Suppose that "2H" as the pixel data is written in the frame buffer 106 at the areas corresponding to the pixels $P_1$ and $P_2$, "1 1 1 1 1 1 1 1, 0 0 0 0 0 0 0 0, 0 0 0 0 0 0 0 0" are written as R, G, B at the address 2H of the LUT 108, and "0 0 0 0 0 0 0 0, 1 1 1 1 1 1 1 1, 0 0 0 0 0 0 0 0" are written as R, G, B in the LUT 108 at the address 1H.

When no color change is performed under this condition, the pixels $P_1$ and $P_2$ show pure red according to the color data "1 1 1 1 1 1 1 1, 0 0 0 0 0 0 0 0, 0 0 0 0 0 0 0 0". On the other hand, when the change pixel data (B2, B1, B0)=(1 0 0) are written in the overlay memory 107 at the area for the pixel $P_1$ so as to change the color of the pixel $P_1$ to pure green, the color data, "0 0 0 0 0 0 0 0, 1 1 1 1 1 1 1 1, 0 0 0 0 0 0 0 0" stored in the LUT 108 at the address $FF_H$ by the change pixel data, are outputted, thereby showing the pixel $P_1$ in pure green. However the pixel $P_2$ remains pure red as it is.

Then when the data in the area for the pixel $P_1$ are cleared to "0" in the overlay memory 7 at the area for the pixel $P_1$, the pixel $P_1$ returns to the original pure red.

According to this invention, it is possible, for example, to change only the color of a grid as a background image or to change the color of rubber banding without affecting the colors of other images when entering data by using a mouse.

In the foregoing embodiment, it is assumed that the change pixel data have three bits, and that the color data have 24 bits. With the circuit of FIG. 4, three colors can be changed out of 16.7 million colors ($2^8 \times 2^8 \times 2^8$) while seven colors can be changed out of 16.7 million colors with the circuit of FIG. 5.

In addition, three least significant bits or consecutive seven entries of the LUT 108 are used for storing the change color data. Therefore it is possible not to designate addresses of the pixel data to be stored in the frame buffer 106 when changing colors. Color change can be carried out easily.

What is claimed is:

1. A display apparatus comprising:

(a) a frame buffer for storing pixel data corresponding to each pixel of a display screen;

(b) a first look-up table for converting pixel data read from said frame buffer into color data;

(c) an overlay memory having areas for the respective pixels of said display screen, each of said areas for storing change data representing presence/absence of color change in a desired area and change pixel data representing a change color to be displayed in a desired area when the change data indicates the presence of color change;

(d) a second look-up table for converting the change pixel data read from said overlay memory into color data; and (e) a selector for selecting color data outputted from one of said first look-up table and said second look-up table depending upon the change data in said overlay memory, said change pixel data remaining unchanged for each pixel area of said overlay memory regardless of whether the change data indicates the presence or the absence of the color change for the area so that a change and a non-change of the displayed color in the desired area is controlled by the change data without changing the change pixel data in the overlay memory.

2. A display apparatus according to claim 1, wherein said change data are one-bit data and said selector is a multiplexer for selecting color data according to said change data.

* * * * *